US005634214A

United States Patent [19]

St. Ville

[11] Patent Number: 5,634,214

[45] Date of Patent: Jun. 3, 1997

[54] GOLF GLOVE AND GOLF GRIPPING METHOD

[76] Inventor: James A. St. Ville, 2918 Fifth Ave., #210, San Diego, Calif. 92013

[21] Appl. No.: 323,603

[22] Filed: Oct. 17, 1994

Related U.S. Application Data

[63] Continuation of Ser. No. 15,317, Feb. 9, 1993, abandoned, which is a continuation of Ser. No. 861,524, Apr. 1, 1992, abandoned.

[51] Int. Cl.[6] ..... A41D 19/00

[52] U.S. Cl. ..... 2/161.2; 2/161.1; 473/205

[58] Field of Search ..... 2/20, 159, 160, 2/161.1, 161.2, 161.3, 161.4, 167; 273/188 R, 189 R; 473/59, 205

[56] References Cited

U.S. PATENT DOCUMENTS

| | | | |
|---|---|---|---|
| Re. 31,538 | 3/1984 | Antonious | 2/161 A |
| 2,258,999 | 10/1941 | Nunn | 2/159 |
| 2,456,678 | 12/1948 | Cole | 2/159 |
| 2,465,136 | 3/1949 | Troccoli | 2/161 A |
| 2,559,788 | 7/1951 | Patterson, Jr. | 2/161 A |
| 2,710,970 | 6/1955 | Kennedy | 2/159 |
| 3,581,312 | 6/1971 | Nickels | 2/159 |
| 3,597,765 | 8/1971 | Stanton | 2/161 A X |
| 3,648,292 | 3/1972 | Strickler | 2/161 A |
| 3,848,874 | 11/1974 | Elkins, Jr. | 273/183 B |
| 3,863,271 | 2/1975 | Moroney | 2/161 A |
| 4,000,903 | 1/1977 | Swanson | 2/161 R X |
| 4,089,070 | 5/1978 | Cherry | 2/161 A |
| 4,164,043 | 8/1979 | Fujita | 2/161 A |
| 4,329,741 | 5/1982 | Bach | 2/161 A |
| 4,691,387 | 9/1987 | Lopez | 2/161 |
| 4,843,651 | 7/1989 | Gramza et al. | 2/161.1 |
| 4,864,659 | 9/1989 | Morris | 2/161 A |
| 4,864,660 | 9/1989 | Sawyer | 2/161 A |
| 4,962,547 | 10/1990 | Minnick | 2/161 A |
| 5,218,719 | 6/1993 | Johnson | 2/19 |
| 5,253,367 | 10/1993 | Lappley | 2/161.3 |
| 5,370,606 | 12/1994 | Martel et al. | 2/161.1 X |
| 5,471,682 | 12/1995 | Robins et al. | 2/161.1 |

FOREIGN PATENT DOCUMENTS

| | | | |
|---|---|---|---|
| 2200275 | 8/1988 | United Kingdom | 2/159 |
| 2200575 | 8/1988 | United Kingdom | A41D 19/00 |

*Primary Examiner*—Michael A. Neas

*Attorney, Agent, or Firm*—O'Connor Cavanagh; John D. Titus

[57] ABSTRACT

The present invention is a golf glove which includes padding to assist in properly gripping a golf club and to also protect the hand when playing golf. The glove further includes a visual indicator to assist in properly gripping a golf glove. The glove also incorporates transversely isotropic material in a portion of the glove to assist in a proper fit. The invention also includes a method of gripping a golf club to assure proper grip and grip alignment.

6 Claims, 3 Drawing Sheets

GOLF GLOVE AND GOLF GRIPPING METHOD

This is a continuation of application Ser. No. 08/015,317 filed on Feb. 9, 1993, now abandoned, which is a continuation of application Ser. No. 07/861,524 filed on Apr. 1, 1992, now abandoned.

BACKGROUND OF THE INVENTION

The present invention relates generally to gloves used in gripping and using sporting equipment. Specifically, the present invention relates to golf gloves used to assist the golfer in holding and manipulating a golf club.

Many types of gloves are being used in playing the game of golf. In particular there have been many types of golf gloves that have been developed to aid a player playing golf. Many of these gloves are known to incorporate padding placed on the palm portion of the glove to assist in the proper grip of a golf club. Examples of these gloves are shown in the Swanson patent, U.S. Pat. No. 4,000,903; the Moroney patent, U.S. Pat. No. 3,863,271; the Nunn patent, U.S. Pat. No. 2,258,999; the Bach patent, U.S. Pat. No. 4,329,741; and the Strickler patent, U.S. Pat. No. 3,648,292. Many of these patents employ padding placed across the palm of the hand.

It is also known in the art to have a golf glove that contains a visual indicator which assists in the proper grip of the golf club grip. Examples of these indicators is shown in the Elkins patent, U.S. Pat. No. 3,848,874; and the Minnick patent, U.S. Pat. No. 4,962,547.

Further it is known in the art to use elastic materials to help reduce sagging that occurs in gloves during repeated use. This feature is shown in the Antonious patent, U.S. Pat. Re. No. 31,538.

However, there are still some problems commonly encountered in playing golf that can be solved or assisted with a golf glove. One of the problems with the existing golf gloves is that most padding is positioned to establish a golf grip across the palm of the hand. Most golf teaching today recommends that the golf club be gripped in the fingers rather than the palm of the hand.

Another problem with current golf gloves including padding is that the padding is designed to assist in the gripping of the golf club and is not designed to protect the joints of the players hand.

A further problem in the art is that most indicators incorporated into golf gloves position are used to align the grip so that the thumb of the gloved hand is placed down the shaft of the club. Modern golf instruction prefers to align the hand so that the shaft is placed in line with the v-shaped portion of the hand between the left thumb and forefinger.

A further problem in the art is that golf gloves, which are commonly made out of leather or synthetic leather type materials stretch and lose their shape with repeated use. The use of elastic and velcro closures is known to help reduce this sagging but these solutions only prevent or reduce sagging in one linear direction. A further problem in the art is that there is no golf glove that solves all of the problems outlined above.

SUMMARY OF THE INVENTION

The present invention is a golf glove that incorporates padding to assist in proper gripping of a golf glove. This padding is also designed to protect sensitive portions of the hand which are subject to stresses and abrasion in the play of golf. The padding on the glove is also designed to reduce injuries such as blisters, callouses and to reduce possible inflammation in the joints of the hand. The golf glove further incorporates a visual indicator to assist in the proper placement of the hands when gripping a golf club. The construction of the golf glove includes the use of transversely isotropic material to prevent sagging and stretching of the glove due to repeated use.

DETAILED DESCRIPTION OF THE PREFERRED EMBODIMENT

The drawings are directed to a left-handed glove for a right-handed golfer, but it should be understood that the invention also covers right-handed gloves for left-handed golfers since the padding, indicators and stretch materials apply equally to right or left handed golf gloves. It is common for the golf glove to be worn on the upper hand when the golfer grips the golf glove.

Figure 1:
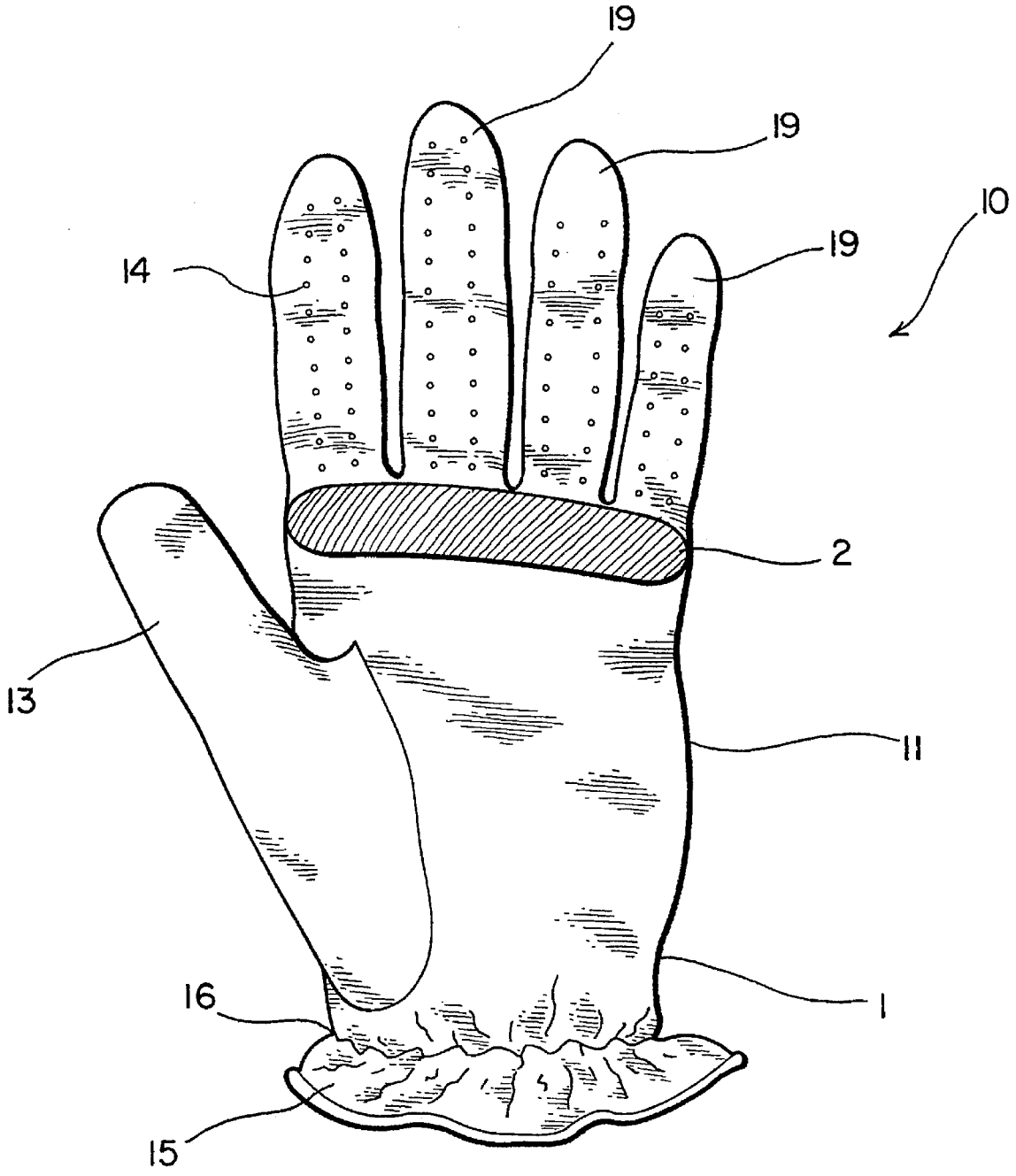
FIG. 1 is a plan view of the palm portion of the golf glove of the present invention.

The golf glove 10 of the present invention is shown in FIG. 1. In FIG. 1 the palm portion 11 of the glove is shown. The glove is of standard configuration and can be made out of any known material, such as leather or synthetic material. Cabretta leather is a well known material for the manufacture of golf gloves.

Figure 2:
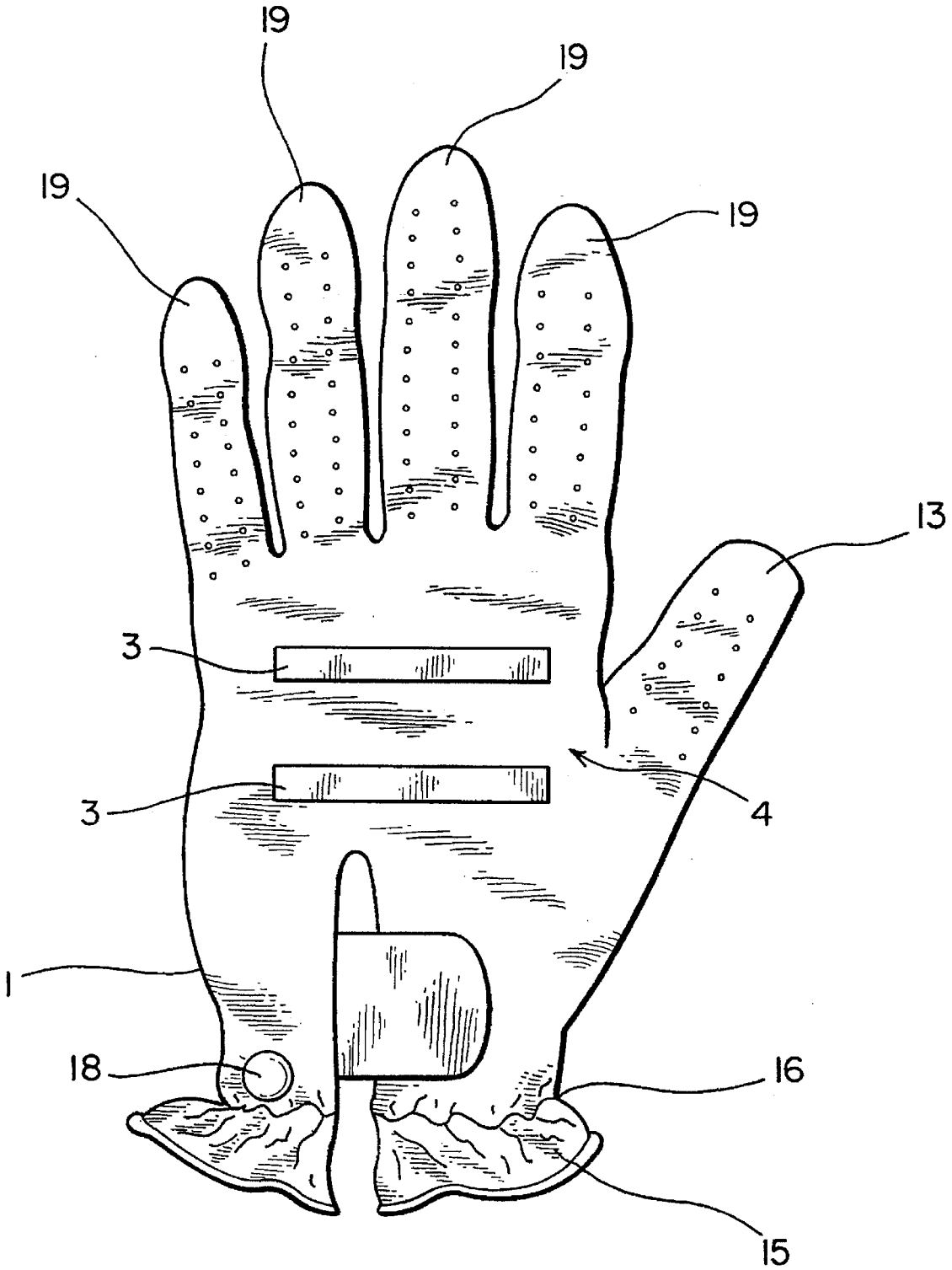
FIG. 2 is a plan view of the back portion of the golf glove shown in FIG. 1.

The glove 10 includes a palm portion 11, a back portion 12, a thumb portion 13 and finger portions 14 and 19. The glove also includes a wrist portion 15 and will generally include an elastic band 16. FIG. 2 shows the back portion of the glove which covers the dorsal surface of the hand. Also visible are closure 17, made of a hook and loop material such as VELCRO, and a snap 18 which is, typically, used as a ball marker. The snap 18 is optional and does not affect the performance of the glove, although it is often found in many golf gloves. These features are those found in commonly available golf gloves.

The glove 10 of the current invention includes a raised pad 2 on the palm portion 11 of the glove. The pad is positioned on the palm surface of the glove such that the user's hand is inserted into the glove, the pad 2 resides adjacent the metacarpal-phalangeal (MCP) joints of the hand. Pad 2 protects the MCP joints during the play of the golf game and serves to restrict torsional movement of the glove material and underlying skin covering the MCP joints during a golf club swing.

When a golf club is gripped with the glove 10 of the present invention, pad 2 facilitates placement of the grip adjacent the proximal phalanges of the user's hand. This causes the club to be gripped by the fingers rather than with palm of the hand. This grip technique is currently taught as the correct position for gripping a golf club.

Pad 2 is preferably comprised of core padding, which may be any known material and is covered with the same material as used to form the palm portion 11 of the golf glove 10. In use, the golf club grip abuts pad 2. In one embodiment, the pad 2 is made of a material which force dispersing, such as cotton or foamed padding. In this embodiment, the padding serves to protect the MCP joint of the hand. This is important because this is an area of the hand that can be injured due to forces transferred to the hand during the golf swing and ball striking. It is preferable that the pad 2 be made of a pliable material so that the padding will not substantially interfere with the golf club grip.

The pad 2 is placed so that it covers the MCP joints of each finger. The padded portion 2 is shaped so that it has a generally straight proximal and distal edges. The terms proximal and distal are used in their anatomical context relative to the anatomy of the hand. The distal edge of pad 2 is in close proximity to the finger portions 14 and 19 of the glove. During gripping, the distal edge of pad 2 abuts the club grip and forces a proper grip wherein the club grip is surrounded by the distal edge of pad 2 and by the phalanges of the hand. This placement of the club assists the player in properly gripping the club.

Proper placement of the club shaft in the grip minimizes harm to the metacarpal-phalangeal joints of the hand during golf play. The proper gripping of the club in conjunction with the pad 2, being placed over the metacarpal-phalangeal joint, combine to reduce the potential of injury to the metacarpal-phalangeal joint during golf play. This will help to reduce the risk of blister and callouses on this portion of the hand. The padding will also reduce the risk of an inflammatory reaction in the metacarpal-phalangeal joints and acts as a protectant from early degenerative arthritis in these joints. The padded portion 2 is of sufficient width so that the padding fully covers the metacarpal-phalangeal joints.

Figure 3:
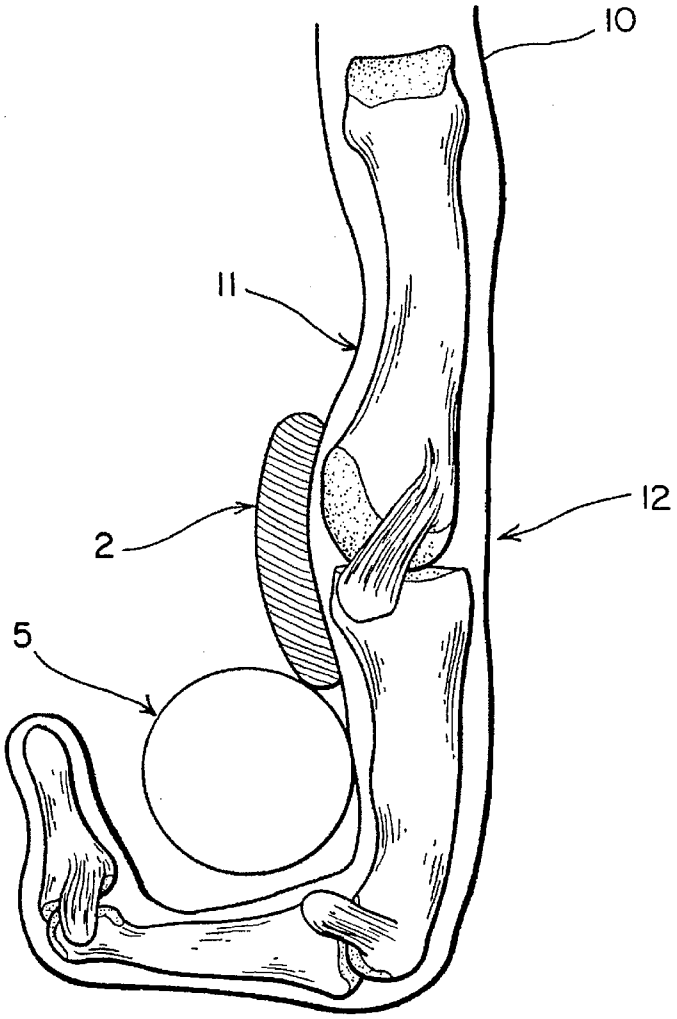
FIG. 3 is a top view of the golf glove shown gripping a golf club.
Figure 4:
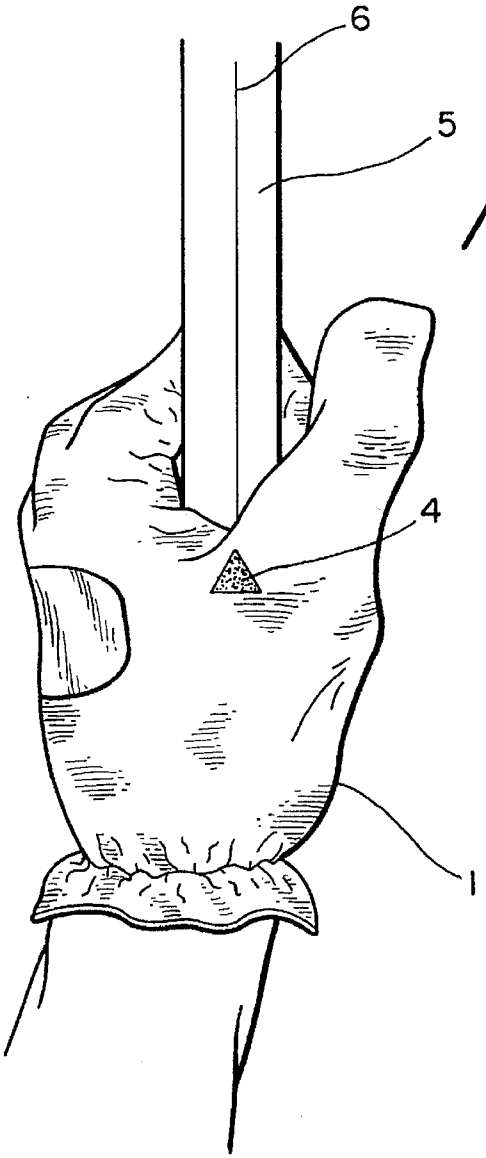
FIG. 4 is a cross section view showing a skeletal view of a finger inserted into the glove of the current invention gripping a golf club shaft.

FIG. 2 shows the back portion 12 of glove 10. A visual indicator 4 is provided and positioned on the back of the golf glove in the area between the thumb stall 13 and the forefinger stall 14, so that it generally covers the thenar eminence of the gloved hand. FIG. 3 shows the glove in use gripping a golf club shaft 5. The visual indicator is located over the thenar eminence of the hand on the top of the golf club shaft 5. When the player grips the golf club shaft, properly alignment of the club relative to the thenar eminence of the hand is ascertained by the position of visual indicator relative to the longitudinal axis of the golf club shaft.

In use, the player would place the glove on his hand. The glove is usually worn on the hand placed highest on the golf club shaft when the club is gripped. Once the glove is placed on the proper hand, the player would select a club and address the ball prior to striking the ball. The player then grips the golf club shaft with his gloved hand. At this point the player could determine whether he has properly gripped the club by glancing down at his gloved hand. If the visual indicator 4 is visibly in alignment with longitudinal axis of the golf club shaft then the player is properly gripping the golf club. If the visual indicator 4 was not visible when the club was gripped the player, while still addressing the ball, would rotate his hand on the grip until the visual indicator was visible and in appropriate alignment.

The visual indicator can also be used to assist in correcting a hook or a slice. A hook is sometimes caused by a closed clubface and a slice is sometimes caused by an open clubface. If a player has a tendency to hook or slice his golf shots then by checking his grip with reference to the visual indicator used in the golf glove, he can either open or close his grip to correct for a hook or a slice. For example, a player who has a tendency to hook his ball, can grip the golf club as he normally does, using the visual indicator to align his grip. The player would then rotate his grip to the open position to thereby compensate for his tendency to hook the ball. The visual indicator would serve as a reference to verify that his grip was open relative to his normal grip.

A second indicator 6 could be attached to the golf club shaft to further assist in grip alignment. In this embodiment, the player aligns the indicator 4 on the golf glove with the indicator on the golf club shaft 6 to assure proper club grip alignment.

The visual indicator 4 can be an insert of a different type of material sewn into the appropriate place on the golf glove or it could be sewn onto the top of the glove. Similarly, any type of indicator could be printed or stamped in the proper location on the glove. It is important the indicator be visually distinctive from the back portion 12 of the glove. Preferably the indicator 4 should have a high degree of contrast from the glove material in order for it to be easily recognized. If two corresponding indicators are used in conjunction with each other, such as an indicator on the glove such as numeral 4 and a second indicator 6 on the golf club shaft, the second indicator could be a self adhesive label which is attached to the golf club shaft. Other known indicators could also be used.

Referring again to FIG. 2, an insert 3, made of a transversely isotropic elastic material is provided in association with the back portion 12 of the glove 10. The remainder of the back portion of the golf glove can be manufactured out of any commonly known material, such as leather or synthetic materials as described above. The insert 3 may be a single insert or a plurality of inserts, each being manufactured of a transversely isotropic elastic material. A commonly known transversely isotropic material is sold in many products under the tradename, ISOTONER. Transversely isotropic materials are characterized by the property wherein the material stretches equally in any planar direction and will then return to its original shape. This material has an advantage over linearly isotropic material which will stretch equally in only a linear direction.

In this preferred embodiment of the present invention, one or more sections have been removed from the back portion of the golf glove and the transversely isotropic material has been inserted in those sections. These inserts 3 allow the glove to stretch in any direction necessary during the play of the golf game, but return the back portion of the glove more nearly to its original shape. Inserts 3 have advantages over standard glove materials, such as leather, which will not return to their original shapes due to the relative be stretched repeatedly during use of the glove and which will not return to their original shapes due to the relative inelasticity of the glove material.

While the invention has been described with references to certain preferred embodiments those skilled in the art will recognize that modifications and variations may be made in construction and material without departing from the spirit and scope of the present invention, which is intended to be limited only by the scope of the claims appended hereto.

I claim:

1. A golf glove of the type having a palm portion, a back portion, a thumb portion, and a plurality of finger portions, including a forefinger portion, said finger portions including a plurality of finger crotches therebetween:

a raised horizontal pad having a proximal and a distal lateral surface, said pad being substantially limited to an area proximally extending from a location immediately adjacent the finger crotches, over the metacarpal-phalangeal joint to a location immediately proximal of said metacarpal-phalangeal joint, and extending laterally from the index finger to the 5th finger, such that a golf club abuts said distal lateral surface when a golfer wearing said golf glove grips the golf club;

a visual indicator placed on a back portion of the glove and positioned between a thumb portion and a forefinger portion of the glove; and at least one insert in the back portion of the glove, said insert consisting of a generally planar portion of elastic material being substantially equally elastic in all traverse directions within the plane of the material.

2. The glove of claim 1 wherein said insert is further located between a wrist portion of the glove and finger portions of the glove.

3. The golf glove of claim 1 wherein said pad area comprises an elastically deformable core.

4. The golf glove of claim 1 wherein said pad area comprises a core made of a foamed material.

5. A Method for a golfer to determine by visual glance whether the golfer has applied a correct grip, comprising the steps of:

a. providing a golf glove worn by the golfer, including a palm portion, a back portion, a thumb portion, a plurality of finger portions, including a forefinger portion, a junction between said palm portion and said plurality of finger portions with a raised horizontal pad having a proximal and a distal lateral surface, said pad being substantially limited to an area proximally extending from a location immediately adjacent the finger crotches, over the metacarpal-phalangeal joint to a location immediately proximal of said metacarpal-phalangeal joint, and extending laterally from the index finger to the 5th finger, and a visual indicator placed on the back portion of said glove between the thumb portion and forefinger portion of said glove;

b. gripping a selected golf club, including a golf club shaft, by placing the shaft of the golf club in a position abutting a distal portion of the horizontal pad such that the golf club is urged distally to be gripped between the first and third phalangeal bones of each finger;

c. visually observing the grip and determining whether said visual indicator is visible to the golfer and substantially aligned with a longitudinal axis of the golf club, so that a corresponding apex between the thumb portion and forefinger are substantially aligned with the longitudinal axis of the golf club; and d. adjusting the grip by turning the gloved hand on the shaft of the golf club so that said visual indicator is visible to the golfer and substantially aligned with the longitudinal axis of the golf club.

6. A method of claim 5, further comprising the steps of:

a. placing a second visual indicator at a selected location on the shaft of a selected golf club; and b. visually observing the grip by the gloved hand on the golf club and determining whether said first visual indicator is substantially visually aligned with said second visual indicator located on the golf club shaft; and c. adjusting the grip of the golf club so that said first visual indicator is visually aligned with said second visual indicator located on the golf club shaft.

* * * * *